US007190317B2

(12) United States Patent
Werner et al.

(10) Patent No.: US 7,190,317 B2
(45) Date of Patent: Mar. 13, 2007

(54) FREQUENCY-AGILE BEAM SCANNING RECONFIGURABLE ANTENNA

(75) Inventors: Douglas H. Werner, State College, PA (US); Thomas N. Jackson, State College, PA (US); Craig S. Deluccia, Clifton Park, NY (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 11/125,432

(22) Filed: May 10, 2005

(65) Prior Publication Data

US 2005/0253763 A1 Nov. 17, 2005

Related U.S. Application Data

(60) Provisional application No. 60/570,419, filed on May 11, 2004.

(51) Int. Cl.
*H01Q 7/00* (2006.01)
*H01Q 9/00* (2006.01)

(52) U.S. Cl. ..... 343/745; 343/866; 343/867

(58) Field of Classification Search ..... 343/745, 343/749, 750, 700 MS, 741, 866, 867
See application file for complete search history.

(56) References Cited

U.S. PATENT DOCUMENTS 5,719,794 A 2/1998 Altshuler et al. ..... 364/578
6,025,813 A * 2/2000 Hately et al. ..... 343/867
6,107,975 A 8/2000 Brennan et al. ..... 343/853
6,529,169 B2 * 3/2003 Justice ..... 343/788
6,675,033 B1 * 1/2004 Lardo et al. ..... 600/410
6,731,246 B2 * 5/2004 Parsche et al. ..... 343/741
2004/0227667 A1 * 11/2004 Sievenpiper ..... 343/700 MS
2005/0179605 A1 * 8/2005 Iigusa et al. ..... 343/745

OTHER PUBLICATIONS

R.L. Li, V.F. Fusco, and R. Cahill, "Pattern shaping using reactively loaded wire loop antenna," IEE Proc. Microwaves, Antennas and Propagation, vol. 148(3), Jun. 2001, pp. 203-208.
W.H. Weedon, W.J. Payne, and G.M. Rebeiz, "MEMS-switched reconfigurable antennas," IEEE Antennas and Propagation Society International Symposium, vol. 3, Jul. 2001, pp. 654-657.

(Continued)

*Primary Examiner*—Tan Ho
(74) *Attorney, Agent, or Firm*—Gifford, Krass, Groh, Sprinkle, Anderson & Citkowski, P.C.

(57) ABSTRACT

An antenna comprises an arrangement of electrically conducting segments, the arrangement including intersection points where two or more electrically conducting segments are in electrical communication. Example antennas include a plurality of capacitors located within some or all of the electrically conducting segments. Capacitance values can be determined using an optimization algorithm to obtain desired values of antenna resonance frequency (or frequencies), bandwidth, and/or radiation pattern, and may be adjusted in order to control an antenna parameter such as beam steering direction.

20 Claims, 14 Drawing Sheets

OTHER PUBLICATIONS

A.D. Chopin, J.C. Bachelor and E.A. Parker, "Design of convoluted wire antennas using a genetic algorithm," IEEE Proc. Microwaves, Antennas and Propagation, vol. 148(5), Oct. 2001, pp. 323-326.

D.S. Linden, "Optimizing signal strength in-situ using an evolvable antenna system," Evolvable Hardware Proc., NASA/DoD Conference, Jul. 2002, pp. 15-18.

C.S. Deluccia, D.H. Werner, P.L. Werner, M.F. Pantoja and A.R. Bretones, "A Novel Frequency Agile Beam Scanning Reconfigurable Antenna," Proceedings of the 2004 IEEE Antennas and Propagation International Symposium, Monterey, CA, Jun. 21-26, 2004, vol. II, pp. 1839-1842.

* cited by examiner

Current Magnitude (A), 0°

Current Magnitude (A), 90°

Current Magnitude (A), 180°

Current Magnitude (A), 270°

0°

45°

90°

135°

180°

225°

270°

315° x-direction, x-y plane y-direction, x-y plane x-direction, x-z plane y-direction, y-z plane -y-direction, x-y plane z-direction, y-z plane -y-direction, y-z plane z-direction, x-z plane x y -y z

FREQUENCY-AGILE BEAM SCANNING RECONFIGURABLE ANTENNA

REFERENCE TO RELATED APPLICATION

This application claims priority of U.S. Provisional Patent Application Ser. No. 60/570,419, filed May 11, 2004, the entire content of which is incorporated herein by reference.

GRANT REFERENCE

The research carried out in connection with this invention was supported at least in part by the U.S. Government under Grant No. NAS5-03014. The U.S. Government may have rights in this invention.

FIELD OF THE INVENTION

The present invention relates to antennas, in particular to reconfigurable antennas.

BACKGROUND OF THE INVENTION

Reconfigurable antennas are attractive because they can provide a high degree of performance versatility. A non-reconfigurable antenna using a wire grid geometry is described in A. D. Chopin, et al., "Design of convoluted wire antennas using a genetic algorithm," *IEE Proc. Microwaves, Antennas and Propagation*, vol. 148, no. 5, October 2001, pp. 323–326. A wire grid geometry using a plurality of relays is described in D. S. Linden, "Optimizing signal strength in-situ using an evolvable antenna system," Evolvable Hardware Proc. NASA/DoD Conference on, July 2002, pp. 15–18. However, the use of relays may restrict the flexibility of the design.

SUMMARY OF THE INVENTION

An antenna comprises an arrangement of electrically conducting segments, including intersection points where two or more electrically conducting segments are in electrical communication. A plurality of the electrically conducting segments include an adjustable element, such as an adjustable capacitor. An antenna parameter, such as the resonance frequency or frequencies, frequency bandwidth, and radiation pattern (including direction of maximum antenna gain, or beam steering direction), can be modified by adjusting the values of the adjustable elements. An optimization algorithm, such as a genetic algorithm, can be used to determine optimized values.

In examples of the present invention, the antenna comprises electrically conducting segments including an adjustable capacitor, the antenna including a plurality of adjustable capacitors. One or more antenna parameters, such as the resonance frequency or frequencies, bandwidth, and radiation pattern (or beam steering direction), can then be dynamically adjusted by adjusting the capacitances of the adjustable capacitors. For example, the adjustable capacitors may be electrically adjustable, and capacitance values selected using an electrical signal from an electrical circuit.

The antenna may further including an antenna feed (or source) located within one of the conductive segments, which may be termed the feed segment. Antennas according to the present invention can be used for transmission, reception, or both, and in other examples the antenna feed can be located anywhere.

The resonance frequency, bandwidth, and radiation pattern of the antenna are adjustable by changing the capacitance of one or more capacitors within the antenna. Values may be selected algorithmically. In examples of the present invention, each electrically conducting segment, except the feed segment, includes a capacitor. Some or all of these capacitors may be adjustable capacitors.

The electrically conducting segments can wires, ribbons (including printed films), or other electrical conductors. In some examples, the electrically conducting segments are proximate to a substrate, for example supported by or printed on a substrate. The substrate may be dielectric substrate. In other examples, the substrate may be a frequency selective surface (FSS), such as an FSS with a reconfigurable conducting pattern.

The electrically conducting segments need not be continuous metal wires, ribbons, or similar conductors, as they may include capacitors, inductors, an antenna feed, or other electrical components.

The electrically conducting segments can be disposed in a generally planar arrangement, with the intersection points being in a square or rectangular grid. In other examples, the segments may be disposed on a curved surface. In other examples, the segments may be disposed on the surface of an imaginary cuboid (such as a cube) to form a volumetric arrangement. For example, the electrically conducting segments may be arranged in a generally cubic arrangement, and the radiation pattern adjusted in three dimensions by changing the capacitance of one or more adjustable capacitors.

The adjustable capacitors can be electrically adjustable, for example including a voltage-tunable dielectric material such as a ferroelectric film. The adjustable capacitors can be adjusted using an external electric signal to continuously vary an antenna parameter, or an antenna parameter may be switched between two or more predetermined values. For example, a resonance frequency may be switched between two or more frequency bands.

Capacitance values can be selected using a genetic algorithm, other optimization technique, or other algorithm, so as to obtain a desired antenna parameter.

DETAILED DESCRIPTION OF THE INVENTION

A novel design methodology is used to design a frequency-agile planar reconfigurable antenna capable of 360° beam scanning in the azimuthal plane. A volumetric antenna is described which is capable of beam steering in three dimensions. Wire versions of planar and 3D designs are described, which can be operated in free space.

A planar antenna is described in which wire segments are replaced with conducting ribbons, and having a finite dimension dielectric substrate. Tuning of both 2-D and 3-D reconfigurable antenna designs can be accomplished using adjustable capacitors, whose values can be determined via a genetic algorithm optimization process.

An improved planar reconfigurable antenna is described, and is shown to be steerable over a full 360° in the azimuthal plane. The antenna resonance can also be tuned, as is demonstrated by considering three different frequency bands. The same antenna design is also capable of being tuned for dual-band operation. This reconfigurable antenna design concept was extended from a planar geometry to a volumetric geometry where a planar reconfigurable array is placed on each of the six faces of a cube. This reconfigurable volumetric array configuration allows beam steering to be achieved in three dimensions, without the degradation usually associated with conventional planar arrays.

In example reconfigurable antennas according to the present invention, adjustable capacitors are used for antenna tuning. This reconfigurable antenna design methodology can support simultaneous tuning and beam steering in the azimuthal plane. For example, a 2×2 wire grid with only 11 adjustable capacitors was found to be sufficient to achieve these results. Beam steering in three dimensions was accomplished by generalizing the design concept to a volumetric wire cube geometry with 47 adjustable capacitors.

Figure 1:
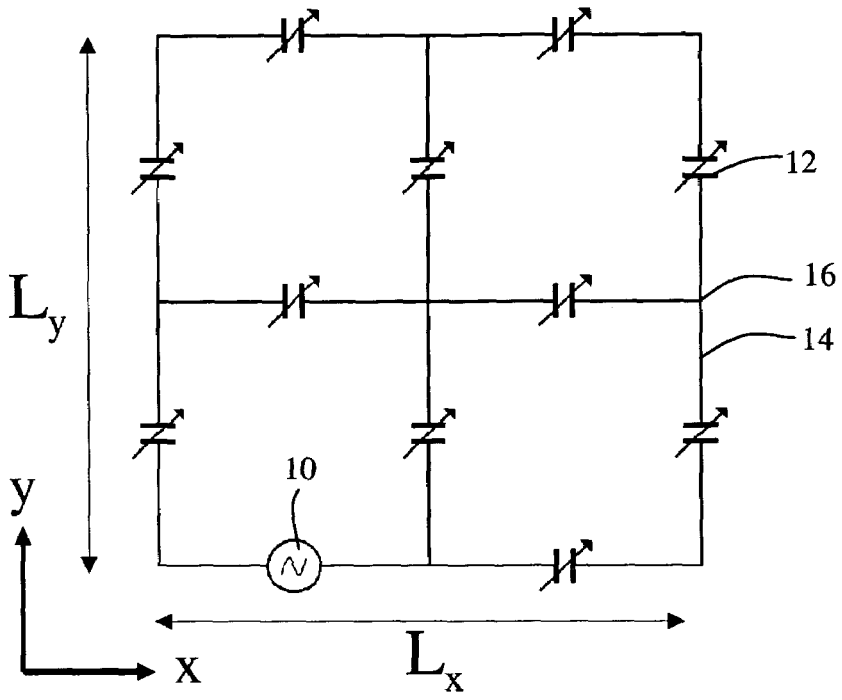
FIG. 1 shows a planar reconfigurable cylindrical wire antenna.

FIG. 1 shows an example design for a planar reconfigurable cylindrical wire antenna. The antenna comprises conducting electrical segments 14, in this example cylindrical wire segments, in electrical communication at intersection points such as 16. An adjustable capacitor 12 is located at approximately the center of an electrically conducting segment. The antenna feed is represented by symbol 10, which typically corresponds to a remote source of electromagnetic energy linked to the antenna by a waveguide or cable. As illustrated, each wire segment is generally straight, terminated at each end by an intersection point. An intersection point is a location where two or more segments come into electrical communication.

The 2×2 reconfigurable planar wire grid antenna can be operated in free space. Adjustable capacitors are placed in the centers of 11 of the 12 cylindrical wire segments that comprise the grid arrangement. The center of the $12^{th}$ segment, located on the edge of the grid, is reserved for the antenna feed 10. An antenna size ($L_x \times L_y$) of 4 cm×4 cm was used for this design in order to provide optimal tunability near 2400 MHz. These dimensions equate to electrical lengths of 0.320λ at 2400 MHz, 0.267λ at 2000 MHz, and 0.213λ at 1600 MHz.

The values of the adjustable capacitors were constrained to lie between 0.1 pF and 1.0 pF. These capacitors were then adjusted using a robust Genetic Algorithm (GA) optimization technique in order to achieve the desired performance characteristics for the antenna. Each capacitor value was encoded in a binary string, and these values were appended to form a chromosome. The fitness of each antenna was evaluated from the gain and input impedance values calculated via full-wave method of moments simulation.

Any 2×2 element planar reconfigurable antenna example can be generalized to an N×N configuration, which provides a more focused beam for applications that require a higher gain reconfigurable antenna.

Figure 2:
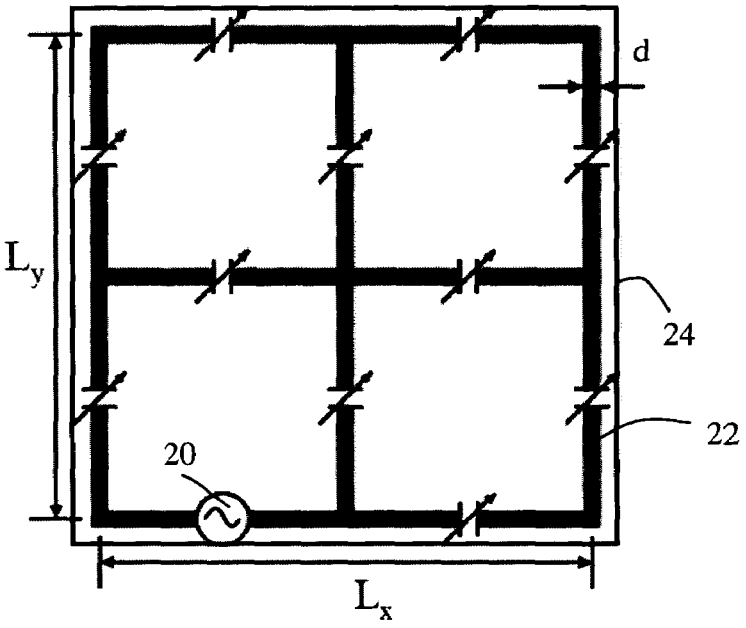
FIG. 2 shows a planar reconfigurable ribbon antenna.

FIG. 2 shows an example design for a planar reconfigurable ribbon antenna. While the planar reconfigurable antenna design shown in FIG. 1 can be optimized relatively quickly for many performance goals, there are some applications where a dielectric-loaded version of the antenna might be desired. A 2×2 grid geometry was used with conducting ribbons replacing the cylindrical wires used in the example of FIG. 1.

The antenna comprises electrically conducting segments, such as 22, supported on a surface of a dielectric substrate 24. In this example, the conducting segments were ribbons printed on the surface of the thin finite size dielectric substrate, having ribbon width d. Antenna length and width are denoted $L_x$ and $L_y$.

A dielectric substrate (e.g., glass) also provides a surface on which supporting components such as thin film transistors (TFTs) can be fabricated and tuning elements can be mounted. In this example, the antenna source 20 and adjustable capacitor locations are identical to those of the cylindrical wire version of the planar reconfigurable antenna of FIG. 1.

Figure 3:
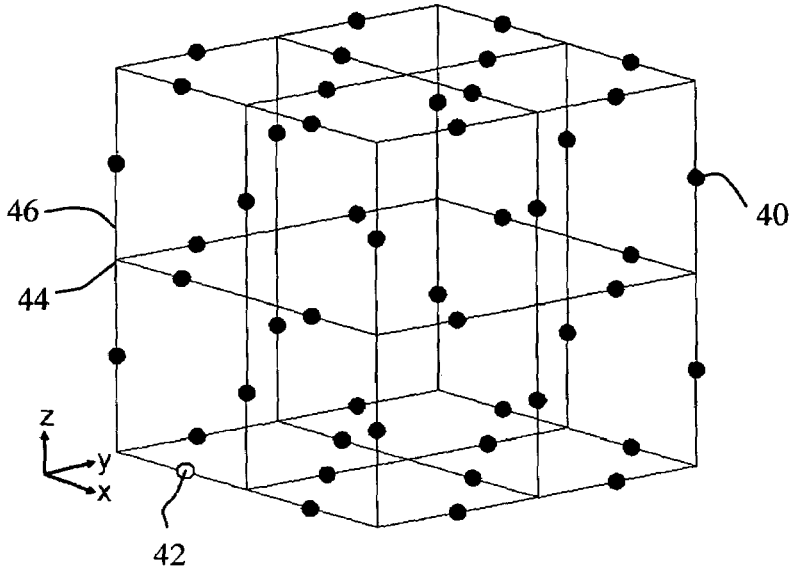
FIG. 3 shows a volumetric reconfigurable cylindrical wire antenna.

FIG. 3 shows an example design for a volumetric reconfigurable cylindrical wire antenna. The volumetric reconfigurable antenna is based on a cubic geometry composed of forty-eight individual wire segments located on the surface of an imaginary cube. The figure shows the segments as lines, such as segment 46, the segments having intersection points such as 44. An adjustable capacitor, represented by a filled circle such as 40, is placed at the center of all but one of these wire segments, while the antenna feed 42 is assumed, for modeling purposes, to be located at the center of remaining segment.

In this example, each edge of the cube antenna measures 3.5 cm, which equates to an electrical length of 0.280λ at 2400 MHz. The values of the adjustable capacitors were again constrained to lie between 0.1 pF and 1.0 pF. However, these and other optimization constraints are optional. In this case a GA was used to determine the settings for each capacitor required to steer the beam of the antenna to any desired location in three-dimensional space.

Simulation Results—Planar Reconfigurable Cylindrical Wire Antenna

Figure 4:
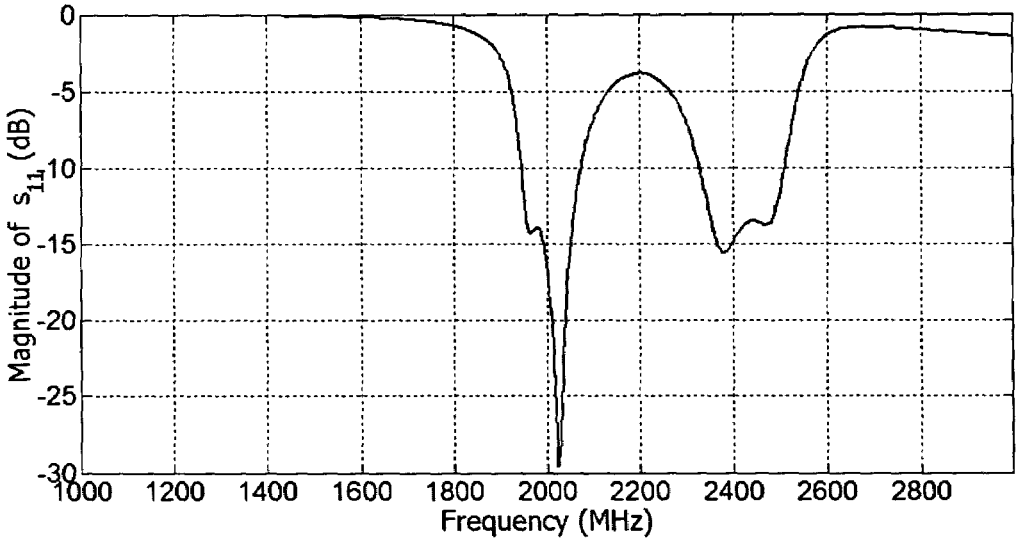
FIG. 4 shows the return loss of a planar reconfigurable cylindrical wire antenna optimized for dual band performance.

FIG. 4 shows the return loss of a planar reconfigurable cylindrical wire antenna optimized for dual band performance. The bandwidths exceeded 100 MHz for both bands. The antenna was optimized by tuning the capacitor values within the aforementioned range of values with the objective of achieving dual-band performance. The center frequencies for each band were specified as 2000 MHz and 2400 MHz. The antenna was optimized for minimum return loss and maximum gain in the $\phi=270°$ direction within both frequency bands. Maximum gains greater than 4 dB were achieved in the $\phi=270°$ direction at both center frequencies.

Figure 5:
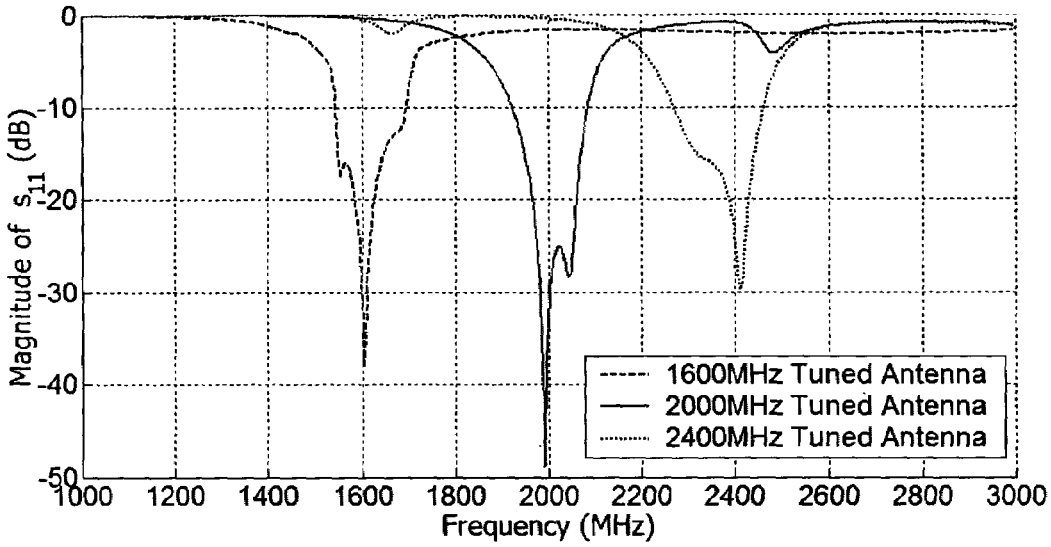
FIG. 5 shows return loss plots for a planar reconfigurable cylindrical wire antenna optimized for resonance in three frequency bands.

FIG. 5 shows return loss plots for a planar reconfigurable cylindrical wire antenna optimized for resonance in three frequency bands. The antenna was optimized (tuned) for resonance at three different arbitrarily chosen center frequencies of 1600 MHz, 2000 MHz, and 2400 MHz. These optimizations were performed without respect to radiation patterns. Bandwidths greater than or equal to 100 MHz were achieved in all three cases.

Figure 6:
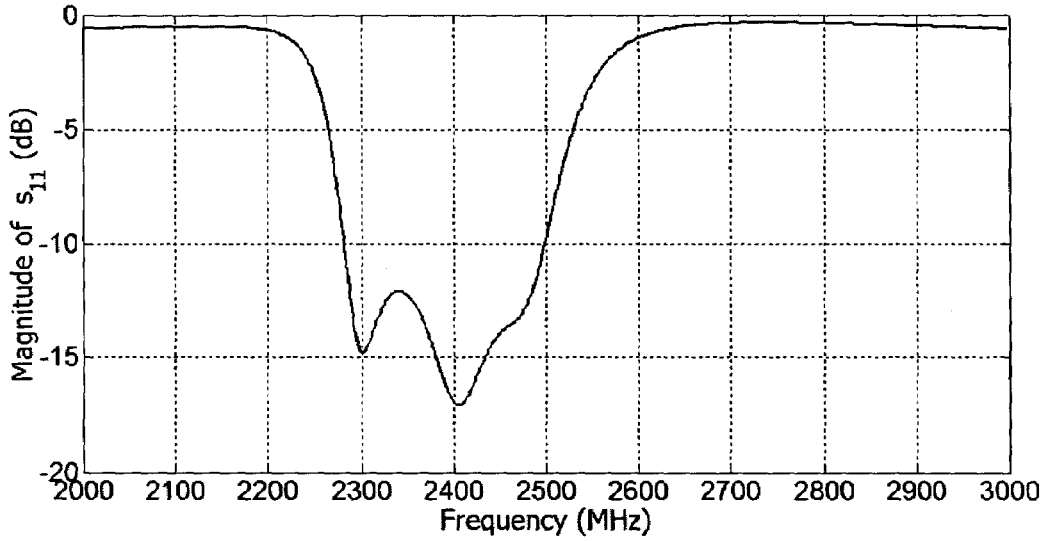
FIG. 6 shows the return loss plot for a planar reconfigurable cylindrical wire antenna optimized for broadband operation.
Figure 7A:
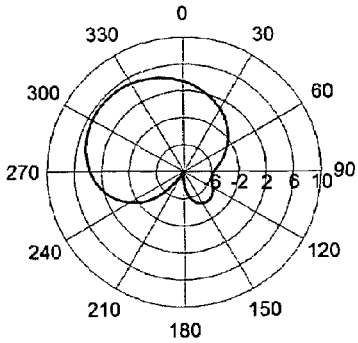
FIGS. 7A–7H show gain in the azimuthal plane of a planar reconfigurable cylindrical wire antenna optimized for maximum gain in eight different directions.
Figure 7B:
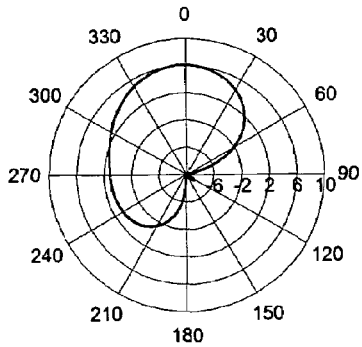
Figure 7C:
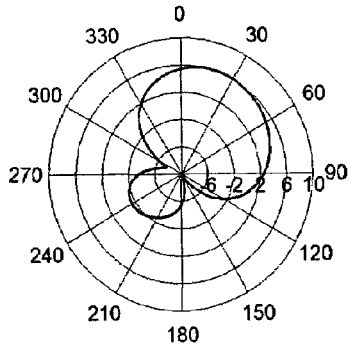
Figure 7D:
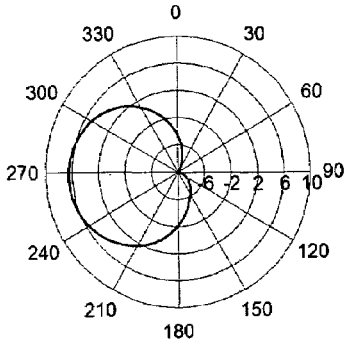
Figure 7E:
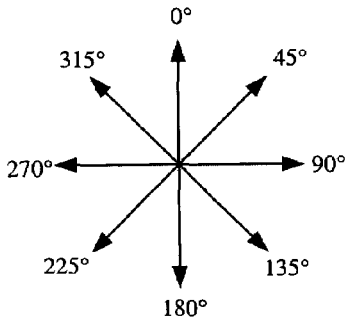
Figure 7E:
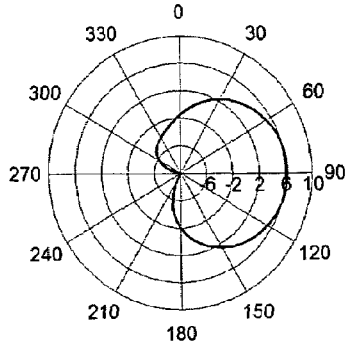
Figure 7F:
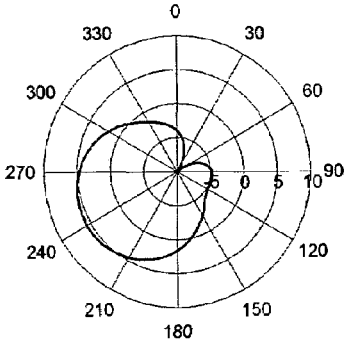
Figure 7G:
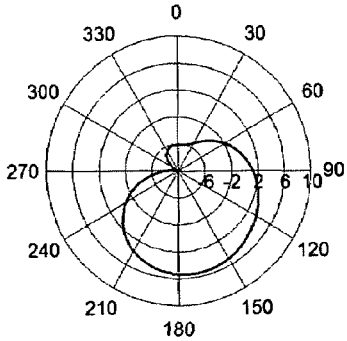
Figure 7H:
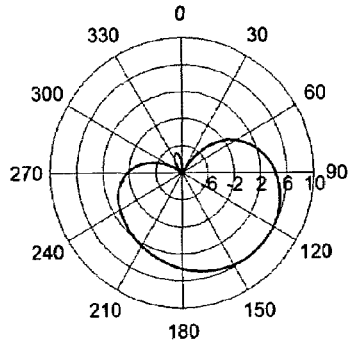

FIG. 6 shows the return loss plot for a planar reconfigurable cylindrical wire antenna optimized for broadband operation. The optimization was performed in order to achieve a relatively large bandwidth irrespective of radiation patterns. To do so, the genetic algorithm optimizer was configured to minimize return loss in the frequency range of 2300 MHz to 2500 MHz, and to suppress out of band resonances. A bandwidth of 200 MHz was obtained.

FIGS. 7A–7H show gain (dB) in the azimuthal plane of a planar reconfigurable cylindrical wire antenna optimized for maximum gain in eight different directions, demonstrating its beam steering capabilities. The antenna was optimized for a direction of maximum gain in eight directions in the azimuthal plane. The location of the figures corresponds to the radiation direction. FIG. 7A–7H correspond directions of 315°, 0°, 45°, 270°, 90°, 225°, 180°, and 135° respectively, the angles being illustrated by the central graphic. Return loss was also simultaneously minimized in each case assuming a center frequency of 2400 MHz. Optimizations were run over several frequency points in order to suppress out of band resonances. Gains exceeding 5 dB at the center frequency, as well as 2:1 SWR bandwidths of at least 50 MHz, were achieved in all cases. The resulting set of radiation patterns demonstrate the beam steering capability in the azimuthal plane.

The direction of maximum gain (for example, beam steering or scanning direction) can be rotated 360 degrees in the azimuthal plane. Antennas according to the present invention may have a direction of maximum gain that rotates.

Figure 8A:
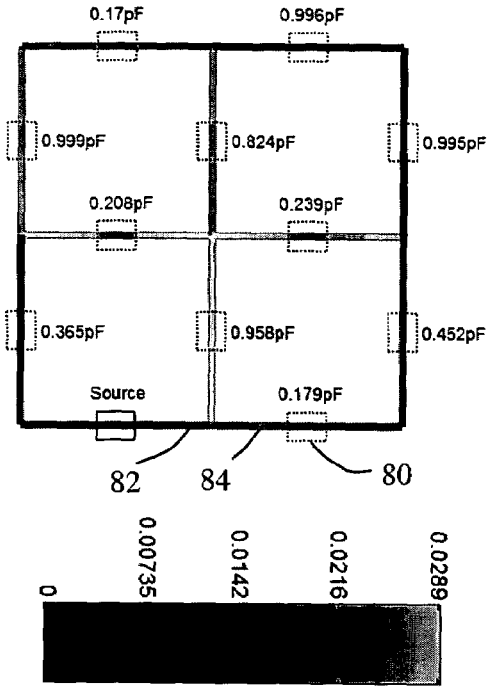
FIGS. 8A–8D show current distributions and capacitor values of the planar reconfigurable cylindrical wire antenna optimized for maximum gain in four selected directions, $\phi$=0°, 90°, 180°, and 270°.
Figure 8B:
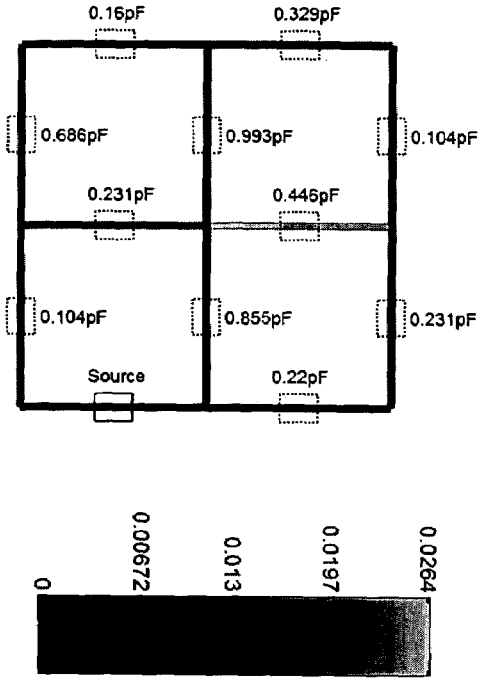
Figure 8C:
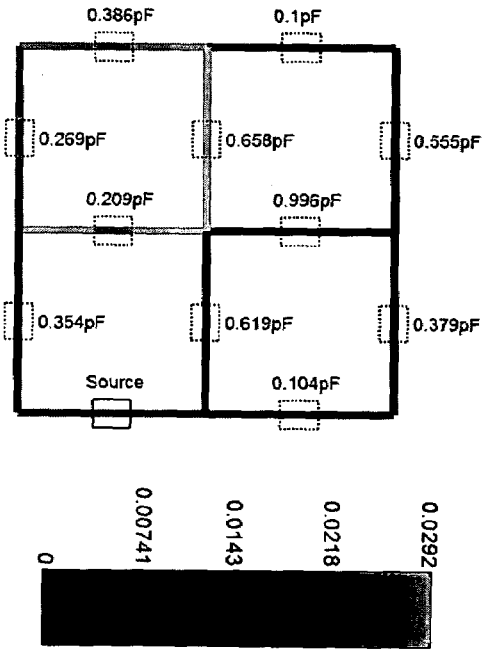
Figure 8D:
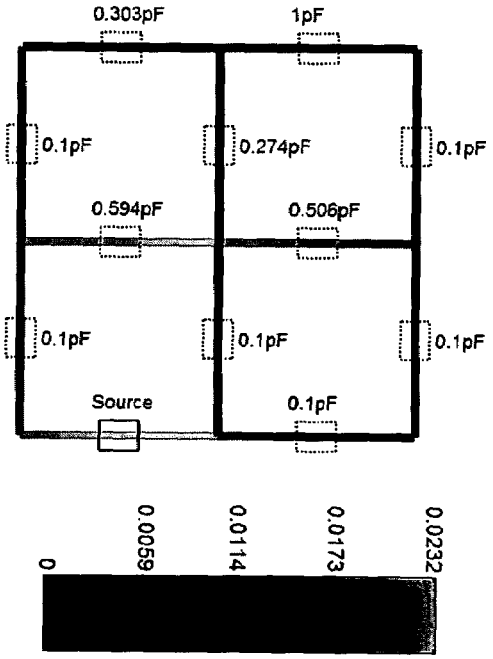
Figure 9A:
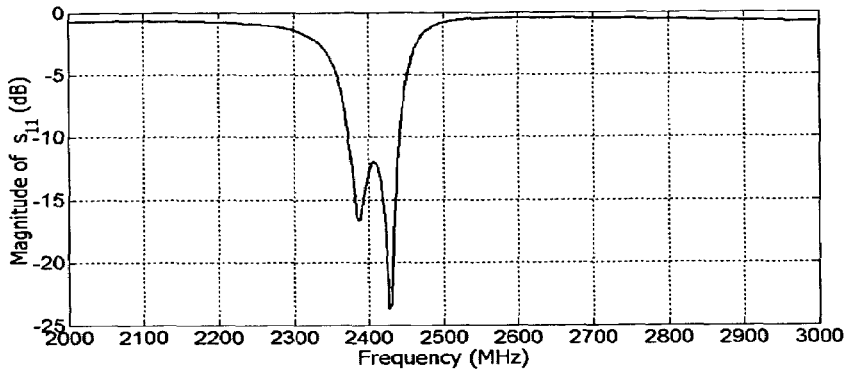
FIGS. 9A–9H show the return loss of the planar reconfigurable cylindrical wire antenna when optimized for maximum gain in eight different directions.
Figure 9B:
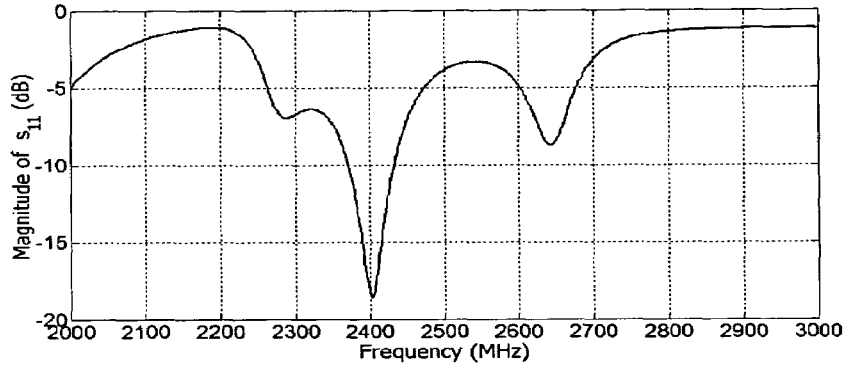
Figure 9C:
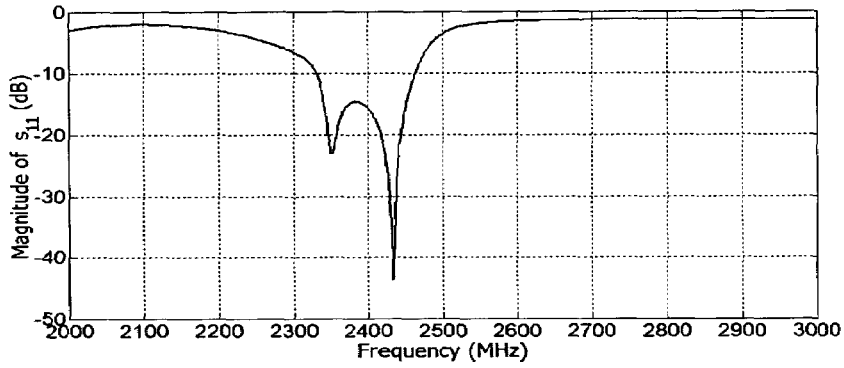
Figure 9D:
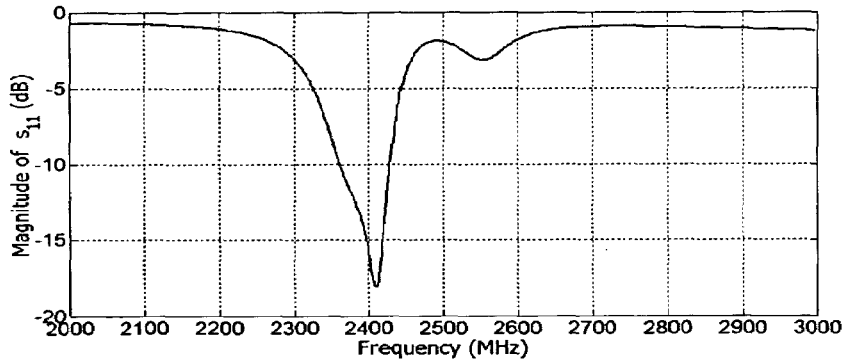
Figure 9E:
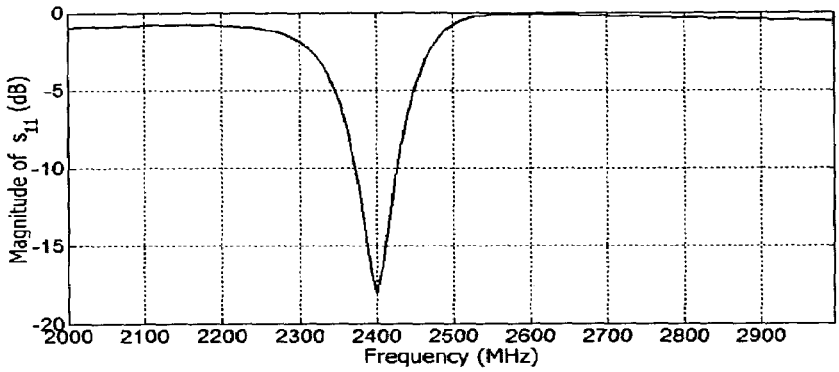
Figure 9F:
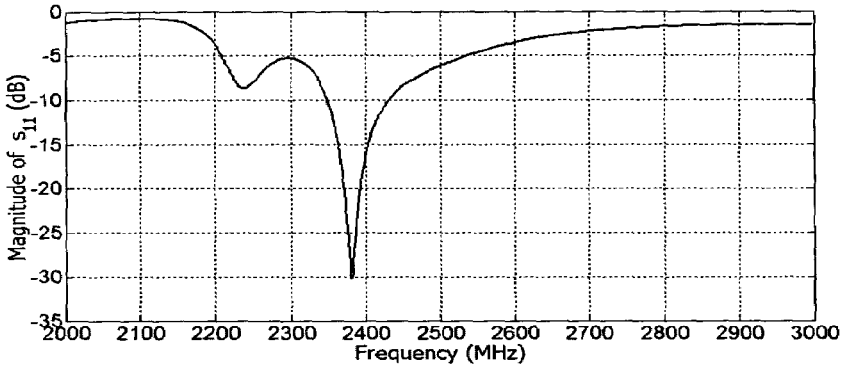
Figure 9G:
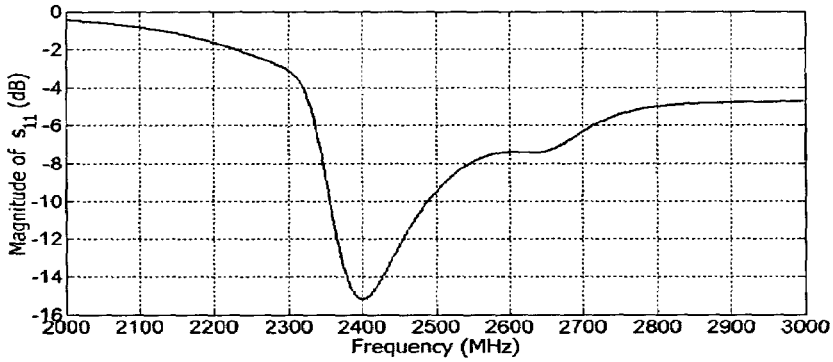
Figure 9H:
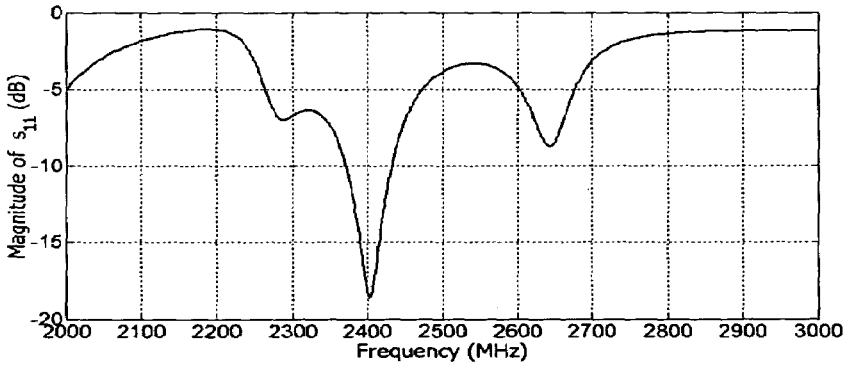

FIGS. 8A–8D show current distributions and capacitor values of the planar reconfigurable cylindrical wire antenna optimized for maximum gain in four selected directions, $\phi=0°$, 90°, 180°, and 270°, respectively. The values of the adjustable capacitors that were selected by the optimizer for each direction are shown in the figures. The current distributions on the antenna aperture are shown as well using a grayscale. It can be seen that the optimized sets of capacitor values controls the current distribution on the antenna aperture, thereby changing the radiation pattern characteristics in the desired way. FIG. 8A shows conducting segments such as 82 (the feed segment), and 84, the segment 84 including capacitor 80.

FIGS. 9A–9H show the return loss of the planar reconfigurable cylindrical wire antenna when optimized for maximum gain in eight different directions. The directions are 0, 45, 90, 135, 180, 225, 270, and 315 degrees respectively.

Simulation Results—Volumetric Reconfigurable Cylindrical Wire Antenna

A volumetric reconfigurable cylindrical wire antenna, such as the antenna shown in FIG. 3, can be optimized to steer the main beam in the x, y, −y, and z directions.

Gain (dB) (i.e. the radiation pattern) of a volumetric reconfigurable cylindrical wire antenna, as shown in FIG. 3, was calculated for antenna optimized for maximum gain in these four directions, i.e. x, y, −y, and z directions. Return loss was also simultaneously minimized in each case assuming a center frequency of 2400 MHz. Optimizations were performed with the additional goals of achieving a bandwidth of 50 MHz while suppressing out of band resonances.

Figure 10A:
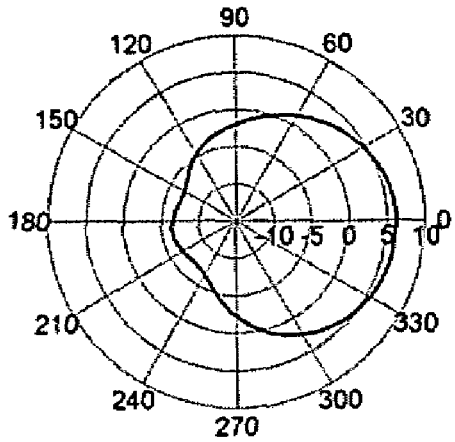
FIGS. 10A and 10B show radiation patterns for an antenna steering in the x-direction.
Figure 10C:
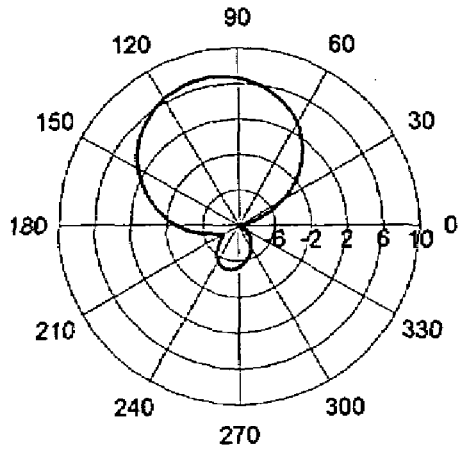
FIGS. 10C and 10D show radiation patterns for an antenna steering in the y-direction.
Figure 10B:
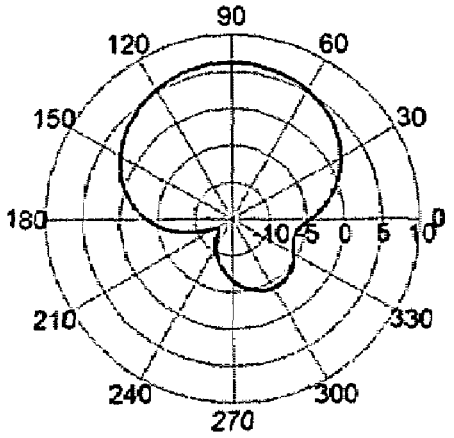
Figure 10D:
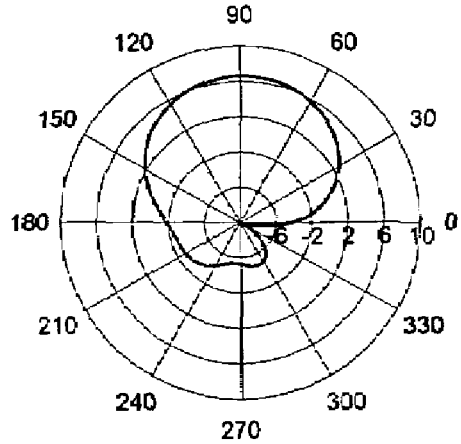

FIG. 10A shows the x-y azimuthal plane radiation pattern, and FIG. 10B shows the x-z elevation plane pattern, for an antenna steering the main beam in the x-direction. FIG. 10C shows the x-y azimuthal plane radiation pattern, and FIG. 10D shows the y-z elevation plane pattern, for an antenna steering the main beam in the y-direction.

Figure 11A:
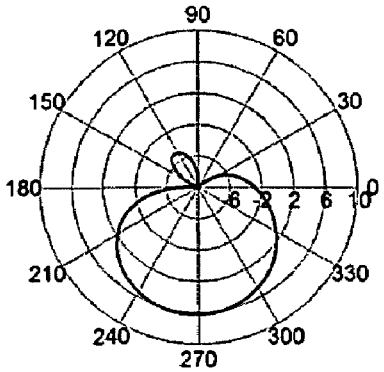
FIGS. 11A and 11B show radiation patterns for an antenna steering in the (−y)-direction.
Figure 11C:
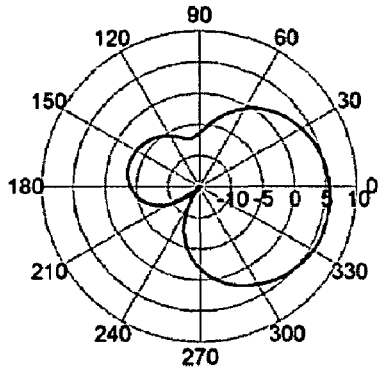
FIGS. 11C and 11D show radiation patterns for an antenna steering in the z-direction.
Figure 11B:
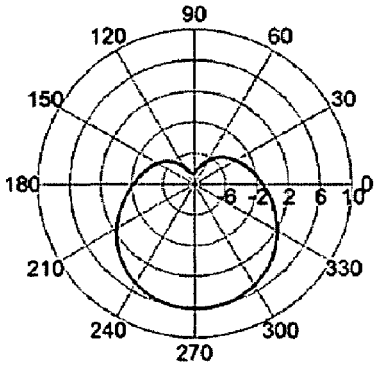

FIG. 11A shows the x-y azimuthal plane radiation pattern, and FIG. 11B shows the y-z elevation plane pattern, for an antenna steering the main beam in the (−y) (minus y) direction.

Figure 11D:
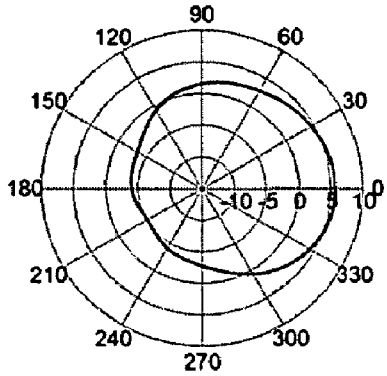
Figure 12A:
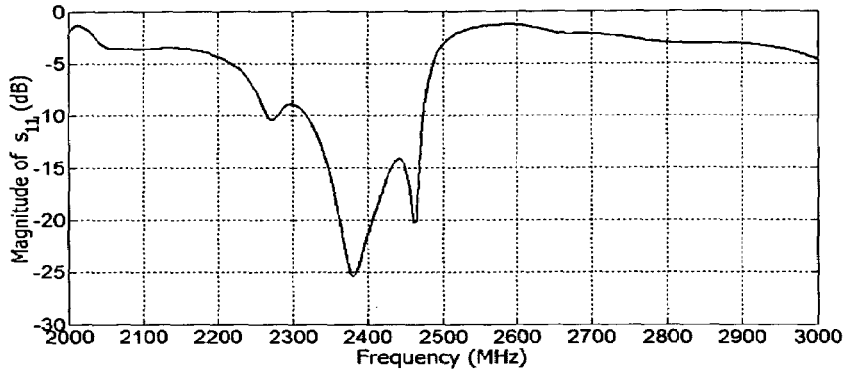
FIGS. 12A–12D show the return loss of the volumetric reconfigurable cylindrical wire antenna when optimized for maximum gain in four different directions, x, y, −y, and z respectively.
Figure 12B:
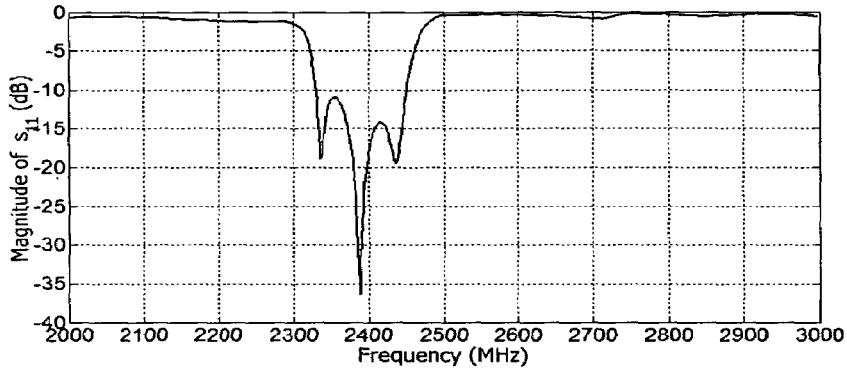
Figure 12C:
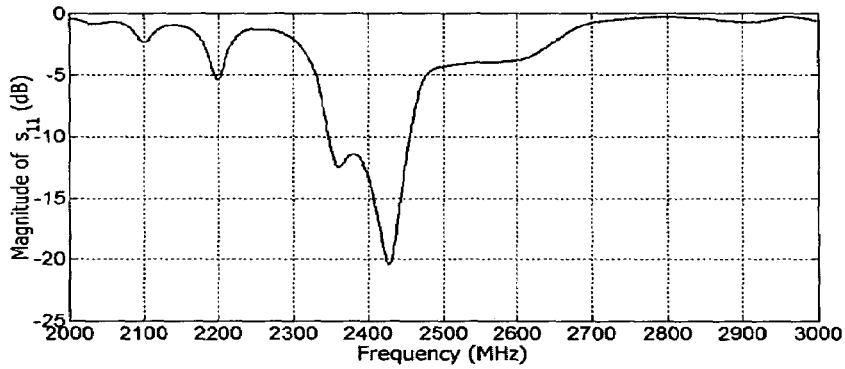
Figure 12D:
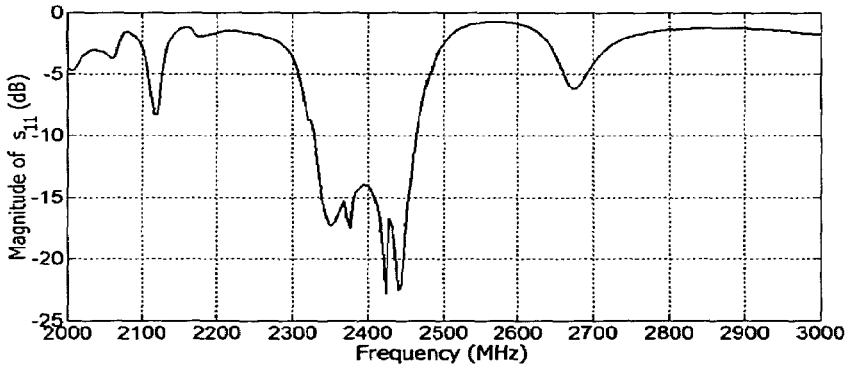
Figure 13A:
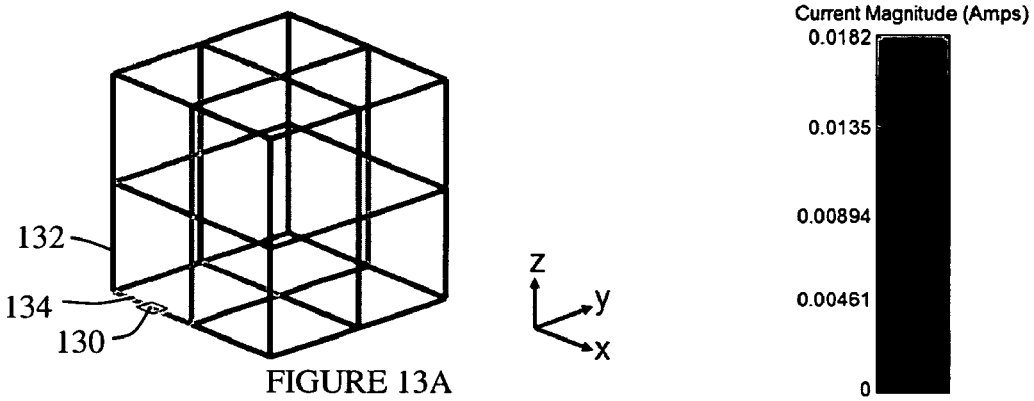
FIGS. 13A–13D show current distributions for the volumetric reconfigurable cylindrical wire antenna optimized for maximum gain in the four different directions, x, y, −y, and z respectively.
Figure 13B:
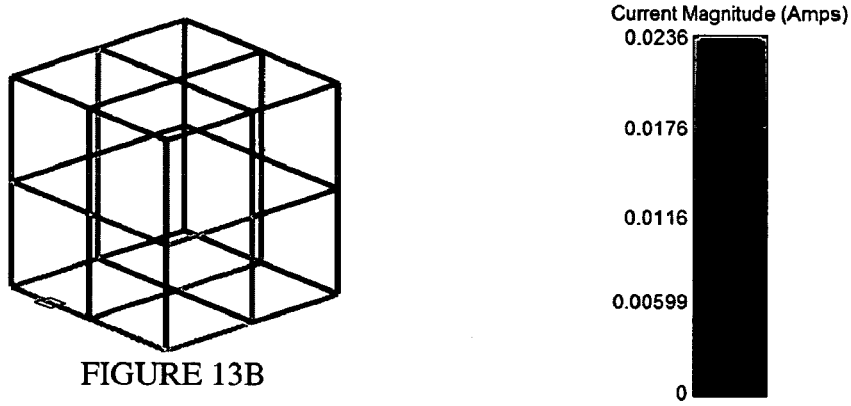
Figure 13C:
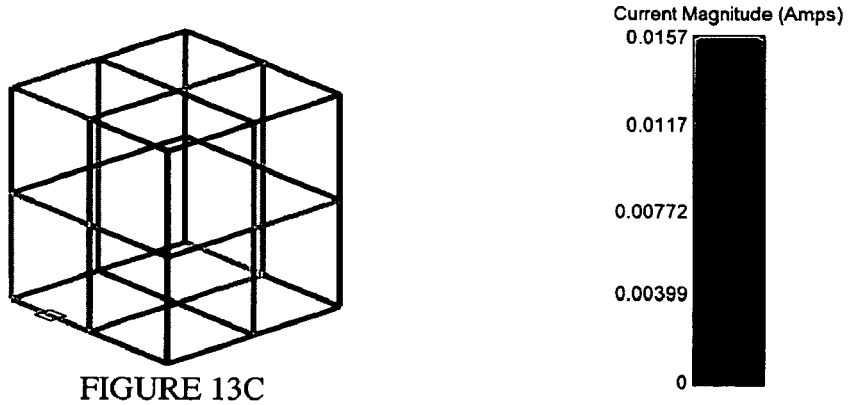
Figure 13D:
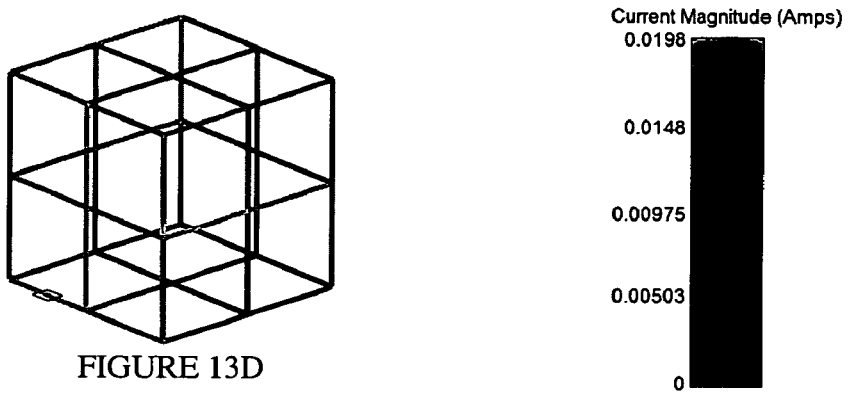

FIG. 11C shows the x-y azimuthal plane radiation pattern, and FIG. 11D shows the y-z elevation plane pattern, for an antenna steering the main beam in the z-direction.

FIGS. 12A–12D show the return loss of the volumetric reconfigurable cylindrical wire antenna when optimized for maximum gain in four different directions, x, y, −y, and z respectively. Gains of 5 dB or greater as well as 2:1 SWR bandwidths of 50 MHz or greater were achieved in all cases.

FIGS. 13A—13D show current distributions for the volumetric reconfigurable cylindrical wire antenna optimized for maximum gain in the four different directions, x, y, −y, and z respectively. The current distributions on the antenna aperture vary significantly for each set of optimized capacitor values. As illustrated, a light gray segments such as 134, which includes antenna feed 130, carries greater current than a dark gray segment such as 132.

Simulation Results—Planar Reconfigurable Ribbon Antenna

Figure 14:
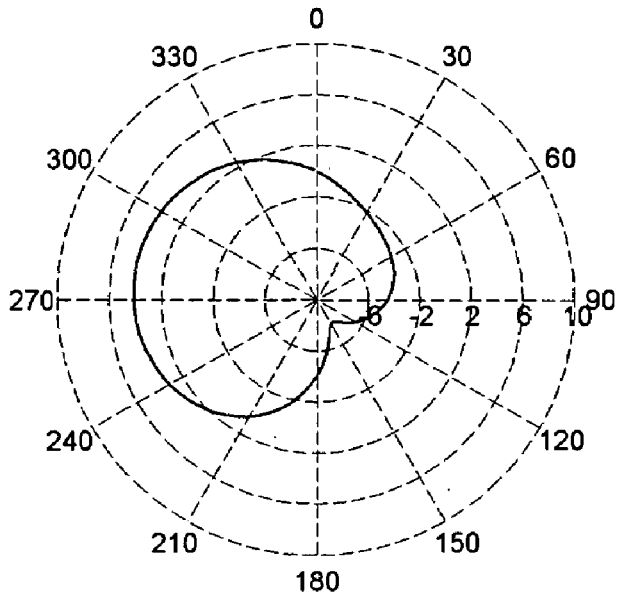
FIG. 14 shows the gain (dB) of a planar reconfigurable ribbon antenna in the azimuthal plane when optimized for maximum gain in the −y direction.

FIG. 14 shows the gain (dB) of a planar reconfigurable ribbon antenna in the azimuthal plane when optimized for maximum gain in the −y direction, for resonance at a center frequency of 2400 MHz. The performance of this antenna was evaluated via full-wave method of moments simulations. The length and width of the antenna were set to 2.9 cm, and the ribbon width d used was 1.0 mm. Capacitor values were again constrained to the range of 0.1 pF to 1.0 pF. A finite dielectric substrate (for example, glass) was added with a relative dielectric constant of 3.8 and dimensions 3.2 cm×3.2 cm×0.1524 cm. The gain at the center frequency in the −y direction was approximately 5 dB.

Figure 15:
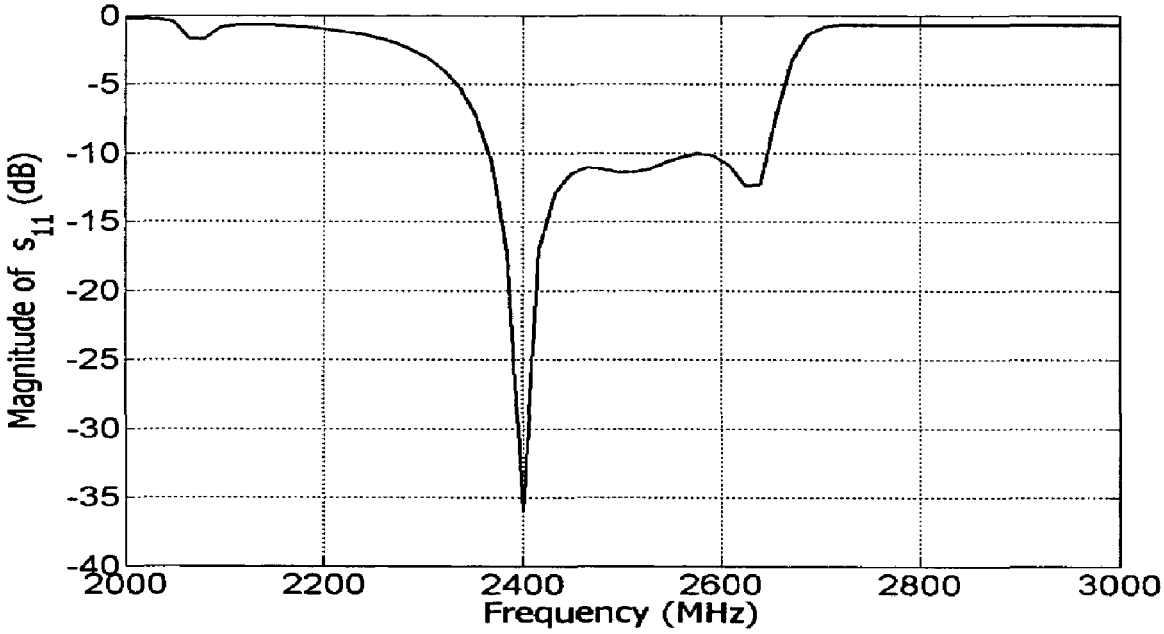
FIG. 15 shows the return loss of a planar reconfigurable ribbon antenna.

FIG. 15 shows the return loss of the planar reconfigurable ribbon antenna of FIG. 14 when optimized for maximum gain in the –y direction. A bandwidth of approximately 75 MHz was achieved.

Figure 16A:
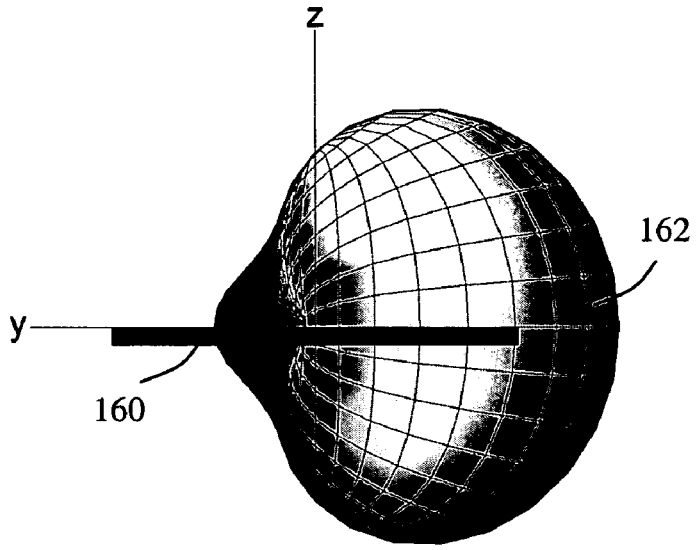
FIGS. 16A and 16B show radiation patterns of a planar reconfigurable ribbon antenna.
Figure 16B:
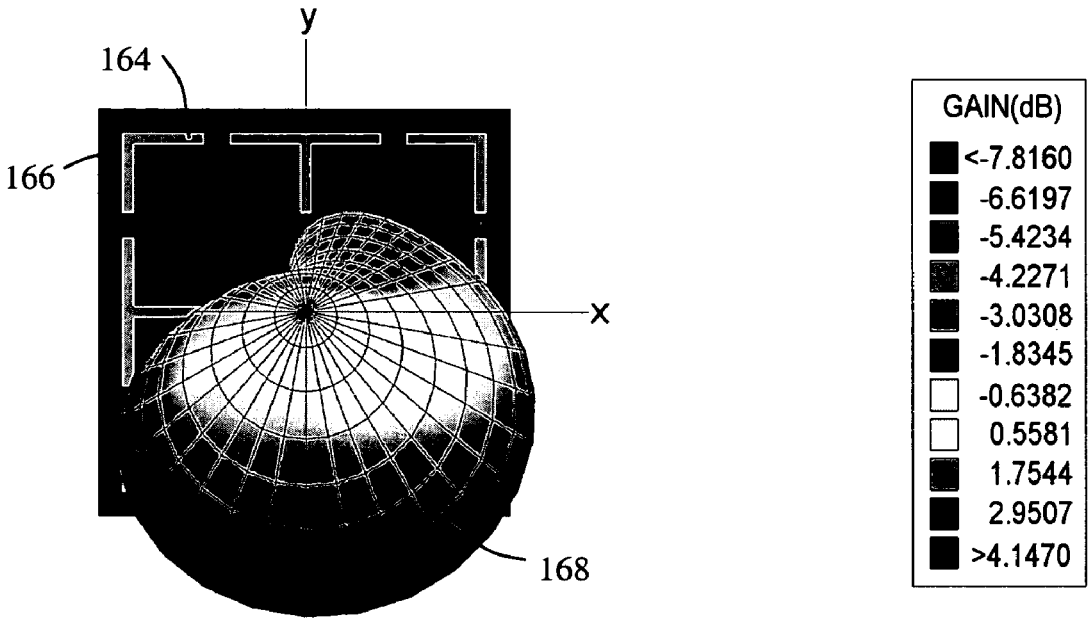

FIGS. 16A and 16B show radiation patterns of the planar reconfigurable ribbon antenna when optimized for maximum gain in the –y direction. FIG. 16A is a side view, and FIG. 16B is a top view. The radiation pattern (162 is the side view, 168 is the top view) is shown in relation to the antenna 160, comprising conducting segments 164 on a substrate 166. These results indicate that performance similar to that of the planar wire geometry can be achieved with the ribbon geometry for this optimization goal.

Optimization

A genetic algorithm technique was used to determine the optimal tuning values for the adjustable capacitors required to achieve a desired performance objective. Other optimization approaches may also be used, including Particle Swarm, Simulated Annealing, Ant Colony, and the like.

Figure 17:
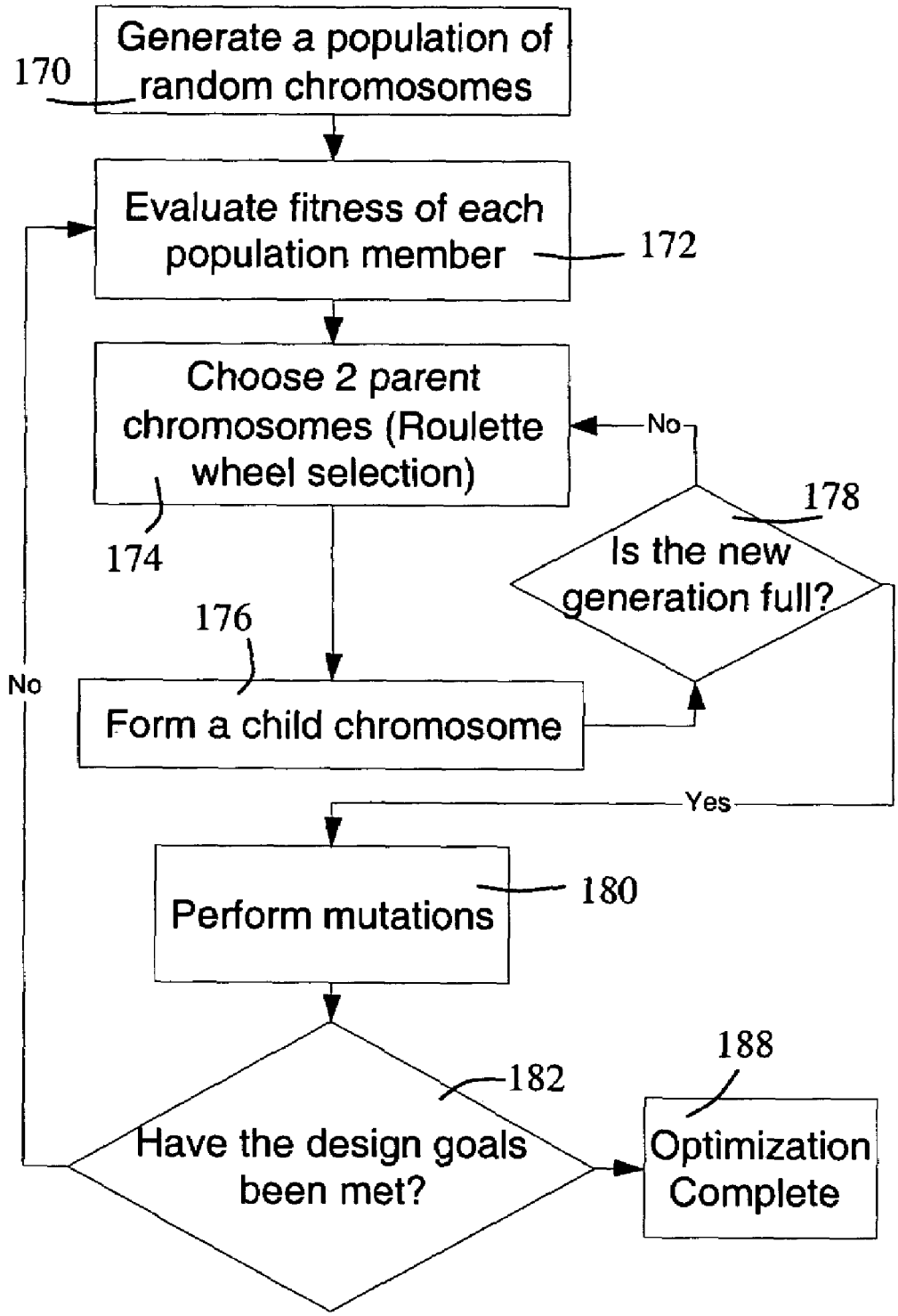
FIG. 17 shows a schematic of an example genetic algorithm which can be used for optimization.

FIG. 17 shows a schematic of an example genetic algorithm which can be used for optimization. Adjustable capacitor values are adjusted using a robust GA optimization procedure in order to achieve various performance characteristics. Capacitor values are encoded in binary strings and appended to generate a chromosome, and several chromosomes are combined to form a population (box 170). A population with randomly selected parameter values is generated to initialize the GA process. The performance of the population members is evaluated via full-wave method of moments (MoM) simulations (box 172). A fitness value is assigned based on gain and return loss data gathered from the MoM simulations. A roulette wheel selection scheme is used to choose parent chromosomes (box 174). Child chromosomes are generated from the parent chromosomes using single point crossover, thereby creating a new generation (box 176). Mutations are performed (box 180), after a full population is obtained (box 178). If the design goals are not met (box 182), the process is repeated from the fitness evaluation step (box 172) until the desired performance goals are met, and the optimization complete (box 188).

Other Examples

Some examples discussed herein considered a 2×2 grid geometry for the reconfigurable cylindrical wire and ribbon antennas. However, in other examples of the present invention, an arbitrary N×N grid geometry can be used. This invention also includes the same type of generalization for the reconfigurable volumetric antenna. Examples of the present invention also include reconfigurable volumetric ribbon antennas printed on a dielectric substrate.

Examples of the present invention can be based on a grid geometry with a single feed point and adjustable capacitor loads. Simulations show that these reconfigurable antenna designs can be tuned to yield a wide variety of performance characteristics. A 2-D antenna can be made by printing conducting ribbons printed on a thin finite dielectric substrate.

Reconfigurable antenna using adjustable capacitors allow great flexibility in design, supporting simultaneous tuning and beam steering in the azimuthal plane. For example, a 2×2 wire grid with only 11 adjustable capacitors was sufficient to achieve beam steering in two dimensions, and beam steering in three dimensions was accomplished by a volumetric wire cube geometry having 47 adjustable capacitors.

Any type of adjustable capacitor can be used in an example reconfigurable antenna according to the present invention. Adjustable capacitors include varactors and TFTs, as well as any devices/components that contain tunable dielectric materials such as BST, and the like. Adjustable capacitors used in examples of the present invention may include MEMS devices, capacitors comprising tunable dielectrics (such as ferroelectrics), electronic varactors (such as varactor diodes), mechanically adjustable systems (for example, adjustable plates), devices having thermal or other radiation induced distortion of an electrical component, other electrically controlled circuits, and other adjustable capacitors known in the art.

An adjustable capacitor may have an electrically tunable dielectric, such as a ferroelectric material. Tunable dielectrics include titanates (including barium strontium titanate (BST), strontium titanate, barium titanate, lead strontium titanate ($Pb(Sr,Ti)O_3$), lead zirconium titanate), tantalates (such as potassium tantalate), niobates (such as lithium niobate, potassium niobate), aluminates (such as lithium aluminate), and the like, including composite and doped materials. An adjustable capacitor may also be an adjustable MEMS capacitors.

An adjustable element may be used in place of the adjustable capacitors in the examples discussed. An adjustable element may comprise an adjustable capacitor, adjustable inductor, adjustable capacitor in combination with a fixed inductor, fixed capacitor in combination with an adjustable inductor, an adjustable capacitor in combination with an adjustable inductor, or other similar combination.

Reconfigurable planar cylindrical wire or ribbon antennas can be used in conjunction with reconfigurable frequency selective surfaces (i.e., reconfigurable electromagnetic bandgap surfaces or artificial magnetic conducting ground planes), such as discussed in our other patent applications, to create low-profile conformal versions of these antennas. A frequency selective surface may be provided including a reconfigurable conductive pattern supported on a dielectric substrate In other examples, switches may be provided at intersection points, so that the interconnection pattern of the conductive elements can be adjusted. The switches may be mechanical (including MEMS switches), semiconductor switches (including photoconductive switches), or any other switch technology. Substrates used to support conducting elements may also support electronic circuitry, such as thin film transistors, configured to adjusting elements such as tunable capacitors.

Examples of the present invention also include non-reconfigurable antennas, for example antennas in which one or more antenna parameters are initially optimized, but then remain substantially unchanged. Antennas according to the present invention may be used to receive or transmit electromagnetic radiation, or both.

The invention is not restricted to the illustrative examples described above. Examples are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

Patents, patent applications, or publications mentioned in this specification are incorporated herein by reference to the same extent as if each individual document was specifically and individually indicated to be incorporated by reference. In particular, U.S. Prov. Pat. App. Ser. No. 60/570,419, filed May 11, 2004, is incorporated herein in its entirety.

Having described our invention, we claim:

1. An antenna comprising an arrangement of electrically conducting segments, the arrangement including intersection points where two or more electrically conducting segments are in electrical communication, at least one electrically conducting segment including an adjustable element, the antenna having an antenna parameter that is adjustable by adjusting one or more adjustable elements, the arrangement of electrically conducting segments including a plurality of loops.

2. The antenna of claim 1, wherein the antenna parameter is selected from a group consisting of resonance frequency, bandwidth, radiation pattern, and beam steering direction.

3. The antenna of claim 1, wherein the adjustable element comprises an adjustable capacitor.

4. The antenna of claim 1, wherein the adjustable element comprises an adjustable inductor.

5. The antenna of claim 1, wherein the electrically conducting segments are wires.

6. The antenna of claim 1, wherein the electrically conducting segments are electrically conducting ribbons formed on a dielectric substrate.

7. The antenna of claim 1, wherein the arrangement is substantially planar, the intersection points being located in a square or rectangular grid.

8. The antenna of claim 1, wherein the arrangement is three-dimensional.

9. The antenna of claim 8, wherein the antenna has a radiation pattern that is adjustable in three dimensions by adjusting one or more of the adjustable elements.

10. The antenna of claim 1, wherein the adjustable element is an adjustable capacitor comprising an electrically tunable dielectric.

11. The antenna of claim 1, wherein the antenna includes a plurality of capacitors having values selected using a genetic algorithm.

12. An antenna, comprising:

an arrangement of electrically conducting segments, the arrangement including intersection points where two or more electrically conducting segments are in electrical communication;

an antenna feed connection located within a feed segment, the feed segment being one the electrically conducting segments; and a capacitor located within each of the electrically conducting segments other than the feed segment, the antenna having an antenna parameter that is adjustable through adjustment of at least one of the capacitors.

13. The antenna of claim 12, wherein the antenna parameter is a direction of maximum gain.

14. The antenna of claim 13, wherein the arrangement is generally planar, the direction of maximum gain being adjustable in two dimensions.

15. The antenna of claim 13, wherein the arrangement is generally cubic, the direction of maximum gain being adjustable in three dimensions.

16. The antenna of claim 12, wherein the antenna parameter is a resonance frequency or frequency bandwidth.

17. The antenna of claim 12, wherein the antenna parameter is adjustable through electrical signals applied to one or more electrically adjustable capacitors.

18. The antenna or claim 12, wherein the arrangement of electrically conducting segments includes at least four loops in a 2×2 grid, the antenna not having a conducting ground plane.

19. An antenna comprising an arrangement of electrically conducting segments, the arrangement including intersection points where two or more electrically conducting segments are in electrical communication, at least one electrically conducting segment including an adjustable element, the antenna having an antenna parameter that is adjustable by adjusting one or more adjustable elements, wherein the arrangement is three-dimensional.

20. The antenna or claim 19, wherein the antenna has a radiation pattern that is adjustable in three dimensions by adjusting one or more of the adjustable elements.

* * * * *

UNITED STATES PATENT AND TRADEMARK OFFICE

CERTIFICATE OF CORRECTION

PATENT NO. : 7,190,317 B2
APPLICATION NO. : 11/125432
DATED : March 13, 2007
INVENTOR(S) : Douglas H. Werner et al.

It is certified that error appears in the above-identified patent and that said Letters Patent is hereby corrected as shown below:

Col. 1, line 3, please insert;

This invention was made with Government support under Grant No. NAS5-03014, awarded by the National Aeronautics & Space Administration. The Government has certain rights in the invention.

Signed and Sealed this

Fifteenth Day of July, 2008

JON W. DUDAS
*Director of the United States Patent and Trademark Office*